US006109061A

United States Patent [19]

Gaskin

[11] Patent Number: 6,109,061

[45] Date of Patent: Aug. 29, 2000

[54] ETHANE REJECTION UTILIZING STRIPPING GAS IN CRYOGENIC RECOVERY PROCESSES

[75] Inventor: Thomas K. Gaskin, Spring, Tex.

[73] Assignee: ABB Randall Corporation, Houston, Tex.

[21] Appl. No.: 09/224,365

[22] Filed: Dec. 31, 1998

[51] Int. Cl.[7] ..... F25J 3/00

[52] U.S. Cl. ..... 62/621

[58] Field of Search ..... 62/621

[56] References Cited

U.S. PATENT DOCUMENTS

| | | | |
|---|---|---|---|
| 4,061,481 | 12/1977 | Campbell et al. | 62/29 |
| 4,140,504 | 2/1979 | Campbell et al. | 62/28 |
| 4,157,904 | 6/1979 | Campbell et al. | 62/27 |
| 4,203,742 | 5/1980 | Agnihotri | 62/24 |
| 4,690,702 | 9/1987 | Paradowski et al. | 62/621 |
| 4,705,549 | 11/1987 | Sapper | 62/621 |
| 4,895,584 | 1/1990 | Buck et al. | 62/621 |
| 5,566,554 | 10/1996 | Vijayaraghavan et al. | 62/621 |

*Primary Examiner*—Ronald Capossela
*Attorney, Agent, or Firm*—Charles D. Gunter, Jr.

[57] ABSTRACT

A process is shown for separating a relatively hot feed gas containing methane, ethane and heavier hydrocarbon constituents into a volatile residue gas and a primarily liquid bottoms. The feed gas is cooled to partially condense the feed gas to form a liquid portion which is expanded and fed to a fractionating column. The expanded liquid portion flows down the column in countercurrent fashion to vapors flowing up the column to separate the relatively less volatile fraction as column bottoms. A side reboiler heats and vaporizes a portion of the liquids flowing down the fractionating column to provide stripping vapors which flow up the column. A portion of the relatively hot, methane rich feed gas entering the process is routed to the column at a selected location in order to raise the relative volatility of liquids near the bottom of the column, resulting in ethane rejection.

9 Claims, 2 Drawing Sheets

ETHANE REJECTION UTILIZING STRIPPING GAS IN CRYOGENIC RECOVERY PROCESSES

BACKGROUND OF THE INVENTION

1. Field of the Invention

The present invention relates generally to a process for the separation of relatively less volatile hydrocarbon constituents from a volatile methane rich gas stream and, more specifically, to such a process in which ethane recovery is minimized due to required operating economies.

2. Description of the Prior Art

Ethane, propane and heavier hydrocarbon constituents can be recovered from a variety of gases, such as natural gas, refinery gas, and synthetic gas streams obtained from various sources. Natural gas ordinarily contains a major proportion of methane and ethane, these constituents comprising greater than fifty mole percent of the feed gas. The gas may also contain lesser amounts of heavier hydrocarbons such as propane, butanes, pentanes, and the like as well as hydrogen, nitrogen, carbon dioxide and other gases. A typical analysis of a feed gas processed in accordance with the present invention might contain, for example, in approximate mole percent, 92.5% methane, 4.2% ethane, and other $C_2$ components, 1.3% propane, and other $C_3$ components, 0.4% isobutane, 0.3% normal butane, 0.5% pentanes plus, with a balance of the feed gas comprising nitrogen and carbon dioxide. In some situations, sulfur containing gases are also present.

Recent substantial increases in the market for ethane and propane components of natural gas have provided a demand for processes which yield higher recovery levels of these products. The cryogenic expansion type recovery process is often preferred for ethane recovery because it is generally simpler than alternative schemes, providing ease of startup, operating flexibility, good efficiency and reliability.

In the typical cryogenic expansion recovery process, a feed gas stream under pressure is cooled by heat exchange with other streams of the process and/or external sources of refrigeration such as a propane compression-refrigeration system. As the gas is cooled, liquids are condensed and collected in one or more separators as high-pressure liquids containing some of the desired $C_2$+components. The high pressure liquids are expanded to a lower pressure and fractionated. The vaporization occurring during expansion of the liquid results in further cooling of the remaining portion of the liquid. The expanded stream, comprising a mixture of liquid and vapor, is fractionated in a distillation (demethanizer) column. In the column, the expansion cooled streams are distilled to separate residual methane, nitrogen, and other volatile gases as overhead vapor from the desired ethane, propane and heavier components as bottoms liquid product.

Typically, the feed gas is not totally condensed and vapor remaining from the partial condensation is passed through a turbo-expander, or expansion valve, to lower the pressure of the stream to a point at which additional liquids are condensed as a result of further cooling of the stream. The pressure after expansion is approximately the same as the pressure at which the distillation column is operated. Liquids thus obtained are supplied as feed to the column. Although condensed liquid is typically expanded in these processes through, e.g., a valve, to column pressure, the primary expansion involved is gas expansion with work recovery and resulting cooling of the gas, which forms additional liquid. Usually, the remaining vapor and the column overhead vapors are combined as a residue methane rich product gas.

In the typical process for recovery of ethane and heavier hydrocarbon constituents from a hydrocarbon gas stream, the residue gas leaving the process will contain substantially all of the methane in the feed gas with essentially none of the heavier hydrocarbon components. The bottoms fraction from the demethanizer column will contain substantially all of the heavier components with essentially no methane or lighter components. At times, fluctuations in the prices of both natural gas and its NGL constituents reduce the incremental value of ethane and heavier components as liquid products. On these occasions, operating economies require that ethane recovery be minimized. This alternative operation is typically accomplished by raising the demethanizer bottoms temperature and rerouting side reboiler connections to the demethanizer, along with reheating feed streams to the demethanizer. Many piping changes are required to accomplish ethane rejection according to conventional practice. Also, ethane rejection can require a larger diameter tower to accommodate the rejected ethane vapor.

It is an object of the present invention to provide a process for ethane rejection in a cryogenic recovery process in which stripping gases present in the inlet gas are used to strip out ethane at a lower temperature than usually required with few, if any, piping realignments being required.

Another object of the invention is to provide an ethane rejection process utilizing a stripping gas in a fractionating column in which there is no need for increased column diameter.

Another object of the invention is to accomplish ethane rejection with ease of operation, lower capital investment requirements, and with increased simplicity of piping, lower reboiler duties, and a smaller required column diameter.

SUMMARY OF THE INVENTION

A process is shown for separation of a relatively high temperature feed gas containing methane, ethane and heavier hydrocarbon constituents into a volatile residue gas containing primarily methane and ethane and a relatively less volatile bottoms fraction. The feed gas is cooled sufficiently to partially condense the feed gas. At least some portion of the feed gas is expanded. At least some of the expanded portion is treated in a fractionating column by flowing liquid downwardly in the column in counter current fashion to vapors flowing up the column to separate the relatively less volatile fraction as column bottoms. The fractionating column includes a reboiler which heats and vaporizes a portion of the liquids flowing down the fractionating column to thereby provide stripping vapors which flow up the column. A portion of the relatively high temperature and ethane-rich feed gas entering the process is routed strategically to the column bottom's section to strip ethane from the downwardly flowing liquids.

Preferably, the feed gas is passed through a mechanical refrigeration step to cool the feed gas sufficiently to partially condense the feed gas. At least some portion of the feed gas is expanded to a lower pressure in a turbo expander, whereby part of the liquid portion vaporizes to cool the expanded liquid portion to a refrigerated temperature. At least some of the expanded liquid portion is treated in a fractionating column by flowing the expanded liquid downwardly in the column in countercurrent fashion to vapors flowing up the column. The fractionating column includes a main reboiler and at least one additional side reboiler which together heat and vaporize a portion of the liquids flowing down the fractionating column to provide stripping vapors which flow up the column and recover refrigeration from the column. The side reboiler has an outlet line and a return line for directing flow to the fractionating column.

A portion of the relatively hot feed gas entering the process is routed to the return line of the side reboiler to aid stripping of ethane from column liquids. The addition of this gas to the column induces stripping by upsetting the existing vapor-liquid equilibrium near the bottom of the column. The relatively high concentration of components lighter than ethane in this gas strip out the ethane without additional heat, thereby resulting in a lower column bottoms temperature and lower bottoms section vapor load than would be achieved if the liquid was deethanized only with heat input.

The main reboiler is located at a first position on the fractionating column and the side reboiler is located at a second, relatively higher position on the fractionating column. A plurality of side reboilers can be provided at spaced vertical locations on the fractionating column with the relatively hot feed gas being routed to the return line of the lowest side reboiler as one convenient point at which to introduce the relatively hot feed gas to the bottom section of the column.

The flow of relatively hot inlet gas is preferably regulated by means of a flow control valve and flow controller to thereby vary the relative percentage of ethane present in the volatile residue gas exiting the column.

Additional objects, features, and advantages will be apparent in the written description which follows.

DETAILED DESCRIPTION OF THE INVENTION

Figure 1:
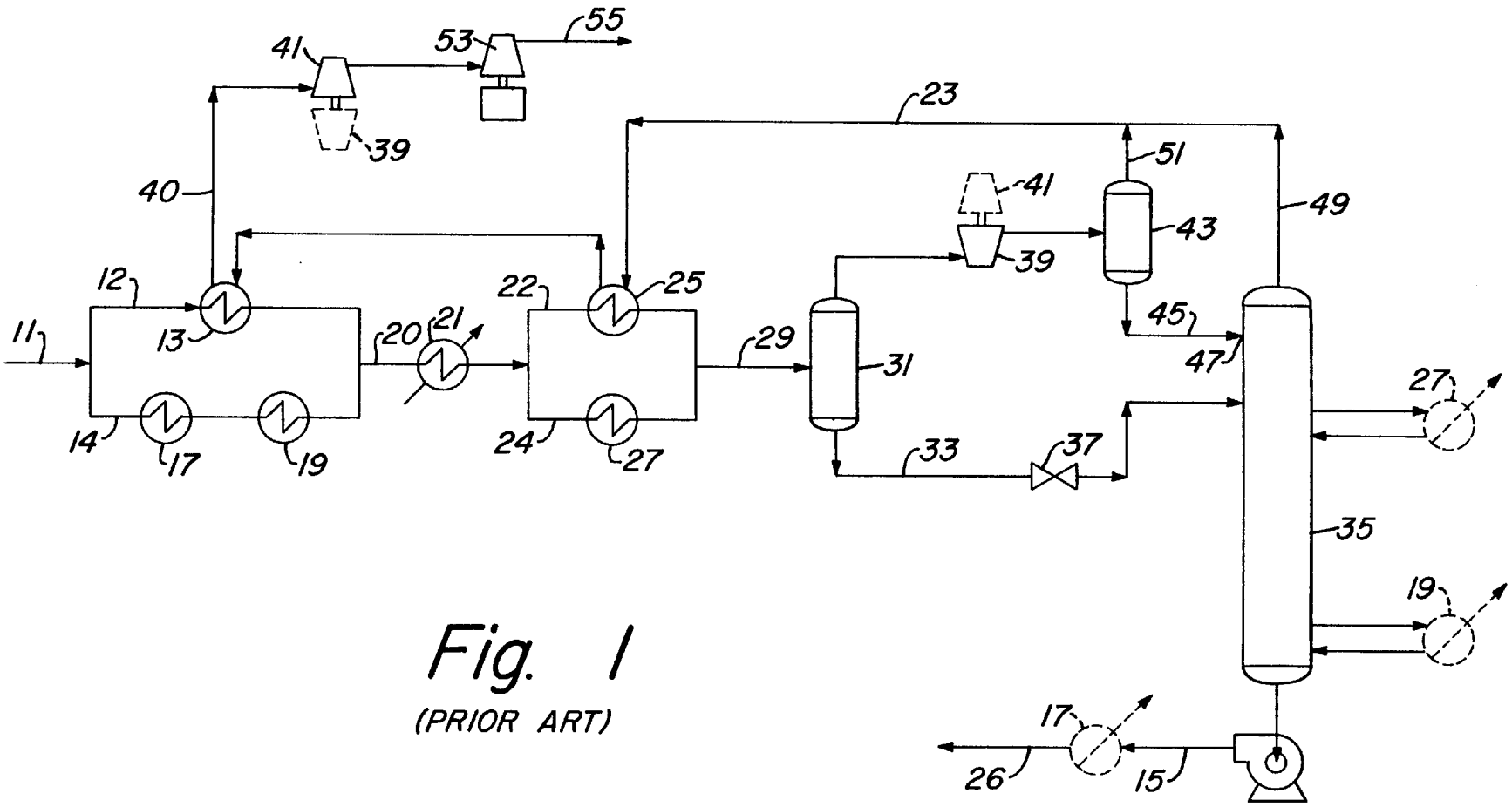
Fig. 1 (PRIOR ART)
FIG. 1 is a schematic diagram of a cryogenic expander natural gas processing plant of the prior art toward which the improvement of the present invention is directed.

Turning to FIG. 1, there is shown a typical ethane recovery process of the prior art. Such processes are described in the patent literature, for example in U.S. Pat. No. 4,157,904, issued Jun. 12, 1979, to Campbell, et al. In the process of FIG. 1, an inlet gas from which carbon dioxide and sulfur components have been removed and which has been dehydrated enters the process at approximately 120° F. and 910 psia in feed gas stream 11. It is divided into two parallel streams 12, 14 and cooled to 45° F. by heat exchange with cool residue gas at 5° F. in exchanger 13; with products liquid in stream 15 at 82° F. in exchanger 17; and with demethanizer liquid at 53° F. in demethanizer main reboiler 19.

After contacting these heat exchangers, the streams recombine to form a stream 20 which enters a gas chiller exchanger 21 where the combined stream is cooled to approximately 10° F. with propane refrigerant at 5° F. The cooled stream is again divided into two parallel streams 22, 24 and further chilled by exchange with the cold residue gas stream 23 at −107° F. in exchanger 25, and with demethanizer liquids at −80° F. in demethanizer side reboiler 27. The streams are recombined, as stream 29, and enter a high pressure separator 31 at −45° F. and 900 psia. The condensed liquid which exits the separator as stream 33 is separated and fed to the fractionating column 35 through expansion valve 37.

The cooled gas from the high pressure separator 31 flows through expander 39 where it is work expanded from 900 psia to 290 psia. The work expansion chills the gas to −125° F. Expander 39 is preferably a turbo expander, having a compressor 41 mounted on the expander shaft. In some cases, the prior art processes have replaced the expander 39 with a conventional expansion valve.

Liquid condensed during expansion is separated in low pressure separator 43. The liquid is fed through line 45 to the fractionating (demethanizer) column 35 at a top feed position 47. In certain of the prior art processes, the low pressure separator 43 is included as a part of the demethanizer 35, occupying the top section of the column. In this case, the expander outlet stream enters above a chimney tray at the bottom of the separator section, located at the top of the column. The liquid then flows from the chimney tray as top feed to the demethanizing section of the column.

As liquid fed to the demethanizer 35 flows down the column, it is contacted by vapors which strip the methane from the liquid to produce a demethanized liquid product as column bottoms. The heat required to generate stripping vapors is provided by heat exchangers 19 and 27.

The overhead vapors stripped from the condensed liquid in demethanizer 35 exit through line 49 to join the cold outlet gas from the separator 43 via exiting in line 51. The combined vapor stream then flows through line 23 and through heat exchangers 25 and 13. After passing through these exchangers, the gas in stream 40 flows through compressor 41 driven by expander 39. Compressor 41 compresses the gas to a discharge pressure of about 305 psia. The gas then enters a compressor 53 and is compressed to a final discharge pressure of about 900 psia. The residue gas exits the process through the discharge conduit 55.

As briefly discussed, the fractionating column 35, referred to as a demethanizer in the description of the prior art process, is a conventional distillation column containing a plurality of vertically spaced trays, one or more packed beds, or some combination of trays and packing. The trays and/or packing provide the necessary contact between the liquids falling downward in the column and the vapors rising upward. The demethanizer includes as heat inputs the reboilers 19, 27 which heat and vaporize a portion of the liquids flowing down the column to provide the stripping vapors which flow up the column. These vapors strip the methane from the liquids so that the bottom liquid product, stream 26, is substantially devoid of methane and is comprised of the majority of the $C_2$ components and heavier hydrocarbons contained in the NGL feed stream.

The inlet and liquid component flow rates, outlet liquid recoveries and compression requirements for the prior art process described in U.S. Pat. No. 4,157,904, discussed above are summarized in Table 1 below:

TABLE I (FIG. 1)

STREAM FLOW RATE SUMMARY - LB. MOLES/HR

| Stream | Methane | Ethane | Propane | Butanes+ | TOTAL |
|---|---|---|---|---|---|
| 11 | 1100 | 222 | 163 | 130 | 1647 |
| 33 | 795 | 202 | 157 | 129 | 1300 |
| 45 | 16 | 10 | 5 | 1 | 32 |
| 15 | 3 | 162 | 157 | 130 | 453 |

TABLE I-continued

| (FIG. 1) | | |
|---|---|---|
| RECOVERIES | | |
| Ethane | 72.9% | 29,296 GAL/DAY |
| Propane | 96.2% | 39,270 GAL/DAY |
| COMPRESSION HORSEPOWER | | |
| Refrigeration | | 256 BHP |
| Recompression | | 892 BHP |
| TOTAL | | 1148 BHP |

Figure 2:
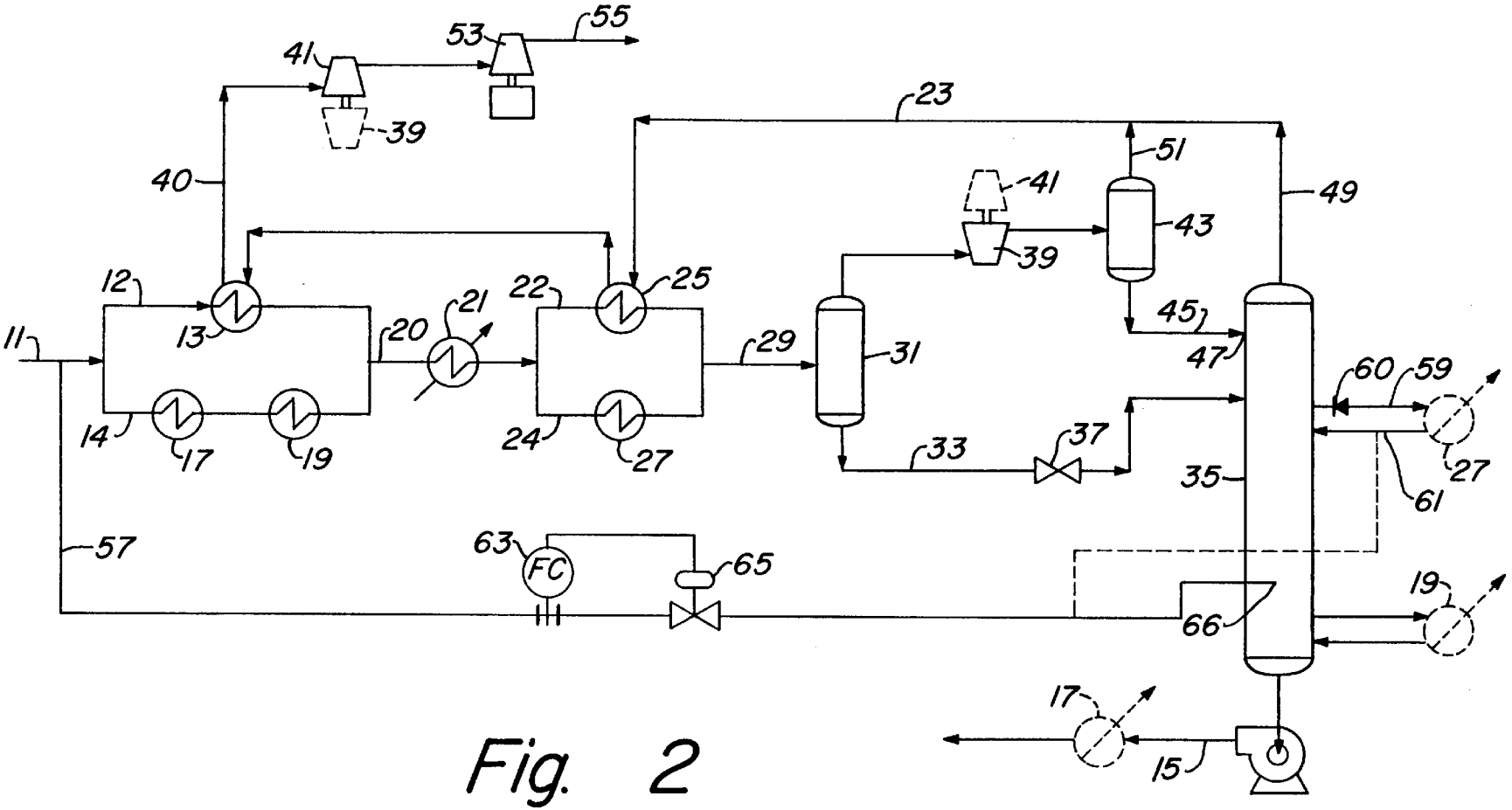
FIG. 2 is a schematic diagram, similar to FIG. 1, showing a cryogenic expander natural gas processing plant which incorporates the improvement of the present invention.

FIG. 2 shows the improved process of the invention which accomplishes ethane rejection using stripping gases in the column 35 with very few piping or additional equipment changes. In the process illustrated in FIG. 2, the feed gas entering the inlet 11 is cooled sufficiently to partially condense the feed gas and form a liquid portion of the feed gas and a vapor portion of the feed gas. At least some of the liquid portion of the feed gas is expanded, for example in turbo expander 39. At least some of the expanded liquid portion is treated in the fractionating column 35 by flowing the expanded liquid downwardly in the column in countercurrent fashion to vapors up the column to separate the relatively less volatile fraction as column bottoms passing out line 15.

The fractionating column 35 again includes a main reboiler 19 and a side reboiler 27. The side reboiler 27 is located at a higher relative vertical position on the column 35 than the main reboiler 19. The main reboiler 19 and side reboiler 27 are used to heat and vaporize a portion of the liquids flowing down the fractionating column 35 to thereby provide stripping vapors which flow up the column.

In the process of FIG. 2, a branch conduit 57 diverts a portion of the relatively hot feed gas from the feed gas conduit 11. The relatively hot feed gas in the branch conduit 57 passes through a conventional flow controller 63 and associated flow control valve 65 and enters the column bottom section at a point 66 which, in this case, is above the main reboiler 19. The rerouting of the feed gas does not act to reject ethane by raising the bottom temperature of the column as such. However, the introduction of the feed gas at the point 66 near the column bottom does serve to introduce methane too close to the column bottom, thereby acting as a stripping gas, upsetting the previous vapor/liquid equilibrium. This action allows more ethane to vaporize from the liquid without additional heat input from the reboilers.

As an alternative to supplying the feed gas at the point 66, the side reboiler 27 can be provided with an outlet line 59, a flow control valve 60 and a return line 61 (FIG. 2). The branch conduit 57 would, in this embodiment, be connected directly to the side reboiler return line 61 (as shown by the dotted line in FIG. 2). While only a single side reboiler is shown in FIG. 2, it will be understood by those skilled in the art that additional side reboilers could be located on the column in spaced vertical fashion. Where multiple side reboilers are present, the branch conduit 57 would be routed to the return line of the lowest side reboiler. The flow control valve 60 located in the return line 59 would normally be closed as feed gas is passed from branch conduit 57 to the side reboiler.

Typically, a flow controller 63 and the associated flow control valve 65 are used to regulate the flow of relatively hot methane-rich inlet gas to the side reboiler return line to thereby vary the bottoms temperature and equilibrium composition of the fractionating column, and, in turn, vary the relative percentage of ethane present in the volatile residue gas exiting column. Any of a number of off the shelf flow controllers are commercially available for this purpose.

One unobvious result and reason for less need for reorienting the process piping and heat exchange in the instant invention is that the temperature at the side reboiler 27 is actually lower than it would be without the gas introduction at the point 66. The gas introduced at point 66 serves to vaporize a portion of the liquid in the column, thereby serving as a source of autorefrigeration.

An invention has been provided with several advantages. The process of the invention provides a convenient means for ethane rejection when operating economies require that ethane recovery be minimized. The process is simple to implement and eliminates the need of expensive piping and equipment changes. It is not generally necessary to increase the size of the fractionating column.

While the invention has been shown in only one of its forms, it is not thus limited but is susceptible to various changes and modifications without departing from the spirit thereof.

What is claimed is:

1. A process for separation of a relatively hot, methane rich feed gas containing methane, ethane and heavier hydrocarbon constituents into a volatile residue gas containing primarily methane and ethane and a relatively less volatile fraction, the process comprising the steps of:

cooling the feed gas;

expanding the feed gas to form an expanded portion containing liquid;

treating at least some of the expanded portion liquid in a fractionating column by flowing the expanded portion liquid downwardly in the column between a top and a bottom thereof in counter current fashion to vapors flowing up the column to separate the relatively less volatile fraction as column bottoms;

wherein the fractionating column includes a main reboiler which heats and vaporizes a portion of the liquids flowing down the fractionating column to thereby provide stripping vapors which flow up the column; and wherein a portion of the relatively hot, methane rich feed gas entering the process is routed to a bottom section of the column to upset a normally existing vapor-liquid equilibrium and thereby strip out undesired ethane from the liquid.

2. The process of claim 1, wherein the relatively hot, methane rich feed gas entering the process is routed to a point on the column just above the main reboiler.

3. The process of claim 2, further comprising the steps of:

providing a flow control valve in the branch conduit used to route a portion of the relatively hot inlet gas to the point on the column just above the main reboiler;

regulating the flow of relatively hot inlet gas through the flow control valve to thereby vary the relative percentage of ethane present in volatile gas near the bottom of the column.

4. A process for separation of a relatively hot, methane rich feed gas containing methane, ethane and heavier hydrocarbon constituents into a volatile residue gas containing primarily methane and ethane and a relatively less volatile fraction, the process comprising the steps of:

cooling the feed gas;

expanding the feed gas to form an expanded portion containing liquid;

treating at least some of the expanded portion liquid in a fractionating column by flowing the expanded portion liquid downwardly in the column between a top and a bottom thereof in counter current fashion to vapors flowing up the column to separate the relatively less volatile fraction as column bottoms;

wherein the fractionating column includes a main reboiler and at least one additional side reboiler which together heat and vaporize a portion of the liquids flowing down the fractionating column to thereby provide stripping vapors which flow up the column; and wherein a portion of the relatively hot, methane rich feed gas entering the process is routed through a branch conduit to the side reboiler to upset a normally existing vapor-liquid equilibrium and thereby strip out undesired ethane from the liquid.

5. The process of claim 4, wherein the main reboiler is located at a first position on the fractionating column and the side reboiler is located at a second, relatively higher position on the fractionating column and wherein the relatively hot feed gas is introduced to a return line of the side reboiler.

6. The process of claim 4, wherein a plurality of side reboilers are present at spaced vertical locations on the fractionating column and the relatively hot feed gas is routed through the branch conduit to the return line of the lowest side reboiler.

7. The process of claim 5, further comprising the steps of:

providing a flow control valve in the branch conduit used to route a portion of the relatively hot inlet gas to the side reboiler return line;

regulating the flow of relatively hot inlet gas through the flow control valve to thereby vary the relative percentage of ethane present in volatile gas present near the bottom of the column.

8. The process of claim 4, wherein mechanical refrigeration is used to supplement cooling of the feed gas.

9. The process of claim 4, wherein the routing of the relatively hot, methane rich feed gas entering the process through the branch conduit to the column is accomplished by retrofitting an existing process to enhance the removal of ethane from liquid present in a column of the process.

* * * * *